US006185765B1

(12) United States Patent
High

(10) Patent No.: US 6,185,765 B1
(45) Date of Patent: Feb. 13, 2001

(54) INFLATABLE BEACH PILLOW SYSTEM WITH AN ATTACHABLE BLANKET

(76) Inventor: Lois A. High, 41 Jacqueline Dr., Paoli, PA (US) 19301

( * ) Notice: Under 35 U.S.C. 154(b), the term of this patent shall be extended for 0 days.

(21) Appl. No.: 09/337,320

(22) Filed: Jun. 22, 1999

(51) Int. Cl.[7] ..... A47G 9/06
(52) U.S. Cl. ..... 5/419; 5/710; 5/656; 5/417
(58) Field of Search ..... 5/417, 419, 420, 5/656, 710, 655.3, 902; 607/95

(56) References Cited

U.S. PATENT DOCUMENTS

| | | | | |
|---|---|---|---|---|
| D. 293,060 | * | 12/1987 | Botbol | D6/608 |
| 1,418,501 | * | 6/1922 | Weinshenk | 5/417 |
| 4,571,194 | * | 2/1986 | Kiss et al. | 441/1 |
| 4,737,999 | * | 4/1988 | Halverson | 5/710 |
| 5,072,467 | * | 12/1991 | Hunt | 5/417 |
| 5,187,823 | * | 2/1993 | Ferguson et al. | 5/417 |
| 5,303,435 | * | 4/1994 | Haar et al. | 5/420 |
| 5,669,089 | * | 9/1997 | Dees | 5/419 |
| 5,819,343 | * | 10/1998 | Zampirri, Jr. et al. | 5/417 |
| 5,895,118 | * | 4/1999 | Hensley | 5/417 |

* cited by examiner

*Primary Examiner*—Terry Lee Melius
*Assistant Examiner*—James M Hewitt

(57) ABSTRACT

An inflatable beach pillow system with an attachable blanket including a pillow in a generally circular configuration. The pillow has an upper surface and a lower surface and a plurality of inflatable sections. The sections include a circular interior section, an enlarged annular radially exterior section and at least one annular intermediate section therebetween. Each of the sections are individually inflatable. A separately inflatable arcuate section is formed in the exterior section and extends for about ninety degrees of its extent. The arcuate section is adapted to constitute a head pillow when inflated with an inwardly sloping upper surface each of the inflatable sections having an individual valve. A blanket is provided in a circular configuration and adapted to be positioned on the upper surface of the pillow. The exterior surface of the blanket is formed with a plurality of concentric rings to constitute scoring sections with indicia thereon. A plurality of pile-type fasteners are coupled to the lower surface of the blanket and a plurality of pile-type fasteners coupled to the upper surface of the pillow for the releasable coupling therebetween to allow removal between the pillow and blanket.

2 Claims, 3 Drawing Sheets

FIG 7
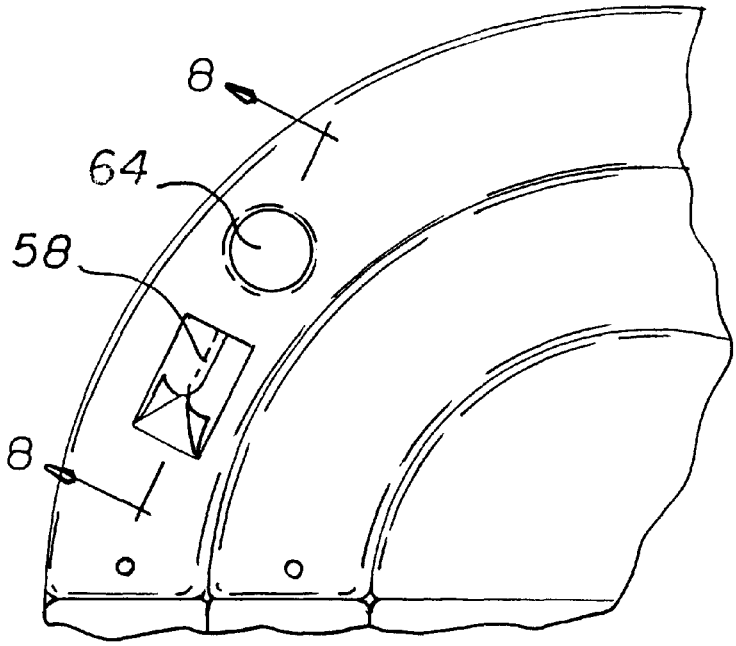
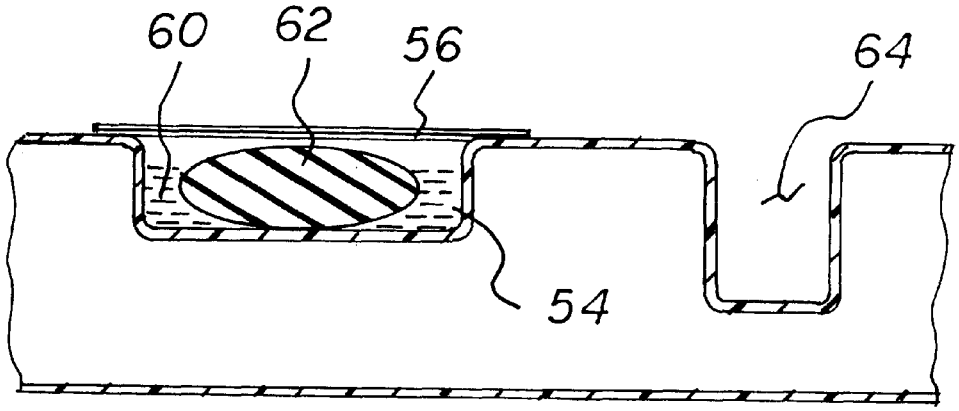
FIG 8

INFLATABLE BEACH PILLOW SYSTEM WITH AN ATTACHABLE BLANKET

BACKGROUND OF THE INVENTION

1. Field of the Invention

The present invention relates to an inflatable beach pillow system with an attachable blanket and more particularly pertains to adding enjoyment and entertainment to people at the beach.

2. Description of the Prior Art

The use of blankets and pillows of known designs and configurations is known in the prior art. More specifically, blankets and pillows of known designs and configurations heretofore devised and utilized for the purpose of intercoupling pillows and blankets through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 390,408 to Kology et al. discloses a Round Sporting Ball Towel. U.S. Pat. No. Des. 366,064 to Milojevich discloses a Display Stand. U.S. Pat. No. Des. 293,060 to Botbol discloses a Circular Towel. U.S. Pat. No. 4,856,912 to Damus et al. discloses a Combination Beach Towel and Tote Bag.

While these devices fulfill their respective, particular objectives and requirements, the aforementioned patents do not describe an inflatable beach pillow system with an attachable blanket as described herein.

In this respect, the inflatable beach pillow system with an attachable blanket according to the present invention substantially departs from the conventional concepts and designs of the prior art, and in doing so provides an apparatus primarily developed for the purpose of adding enjoyment and entertainment to people at the beach.

Therefore, it can be appreciated that there exists a continuing need for a new and improved inflatable beach pillow system with an attachable blanket which can be used for adding enjoyment and entertainment to people at the beach. In this regard, the present invention substantially fulfills this need.

SUMMARY OF THE INVENTION

In view of the foregoing disadvantages inherent in the known types of blankets and pillows of known designs and configurations now present in the prior art, the present invention provides an improved inflatable beach pillow system with an attachable blanket. As such, the general purpose of the present invention, which will be described subsequently in greater detail, is to provide a new and improved inflatable beach pillow system with an attachable blanket and method which has all the advantages of the prior art and none of the disadvantages.

To attain this, the present invention essentially comprises a new and improved inflatable beach pillow system with an attachable blanket for beach use as described herein comprises, in combination a pillow. The pillow is in a generally circular configuration and has an upper surface and a lower surface. The pillow also has three inflatable sections including a circular interior section, an enlarged annular radially exterior section and an annular intermediate section therebetween. Each of the sections are individually inflatable. Also included is a separately inflatable arcuate section. The arcuate section is formed in the exterior section and extends for about ninety degrees of its extent. The arcuate section is adapted to constitute a head pillow when inflated with an inwardly sloping upper surface each of the inflatable sections having an individual valve. Yet another component of the system is a blanket. The blanket is in a circular configuration and is adapted to be positioned on the upper surface of the pillow. The exterior surface of the blanket is formed with a plurality of concentric rings. The rings constitute scoring sections with indicia of "20" on the outermost section, "50" on the innermost section and with "40" and "30" at the sections adjacent thereto. Also included in the system is a plurality of pile-type fasteners. The pile-type fasteners are coupled to the lower surface of the blanket and a plurality of pile-type fasteners are coupled to the upper surface of the pillow for the releasable coupling therebetween to allow removal between the pillow and blanket. Lastly provided is a plurality of recesses. The recesses are formed in the outermost ring of the pillow and are essentially diametrically opposed to the arcuate section with a rectangular recess and a cover patch removably secured thereover by a pile-type fastener for supporting suntan lotion and a saturated pad and a cylindrical recess thereadjacent for the receipt of a beverage container.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable beach pillow system with an attachable blanket which has all of the advantages of the prior art blankets and pillows of known designs and configurations and none of the disadvantages.

It is another object of the present invention to provide a new and improved inflatable beach pillow system with an attachable blanket which may be easily and efficiently manufactured and marketed.

It is further object of the present invention to provide a new and improved inflatable beach pillow system with an attachable blanket which is of durable and reliable constructions.

An even further object of the present invention is to provide a new and improved inflatable beach pillow system with an attachable blanket which is susceptible of a low cost of manufacture with regard to both materials and labor, and which accordingly is then susceptible of low prices of sale to the consuming public, thereby making such Inflatable beach pillow system with an attachable blanket economically available to the buying public.

Even still another object of the present invention is to provide an inflatable beach pillow system with an attachable blanket for Adding enjoyment and entertainment to people at the beach.

Lastly, it is an object of the present invention to provide a new and improved inflatable beach pillow system with an attachable blanket including a pillow in a generally circular configuration. The pillow has an upper surface and a lower surface and a plurality of inflatable sections. The sections include a circular interior section, an enlarged annular radially exterior section and at least one annular intermediate section therebetween. Each of the sections are individually inflatable. A separately inflatable arcuate section is formed in the exterior section and extends for about ninety degrees of its extent. The arcuate section is adapted to constitute a head pillow when inflated with an inwardly sloping upper surface each of the inflatable sections having an individual valve. A blanket is provided in a circular configuration and adapted to be positioned on the upper surface of the pillow. The exterior surface of the blanket is formed with a plurality of concentric rings to constitute scoring sections with indicia thereon. A plurality of pile-type fasteners are coupled to the lower surface of the blanket and a plurality of pile-type fasteners coupled to the upper surface of the pillow for the releasable coupling therebetween to allow removal between the pillow and blanket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an enlarged showing of some of the recesses shown in an enlarged illustration from FIGS. 2 and 6.

FIG. 8 is a cross-sectional view taken along line 8—8 of FIG. 1.

The same reference numerals refer to the same parts through the various Figures.

DESCRIPTION OF THE PREFERRED EMBODIMENT

Figure 1:
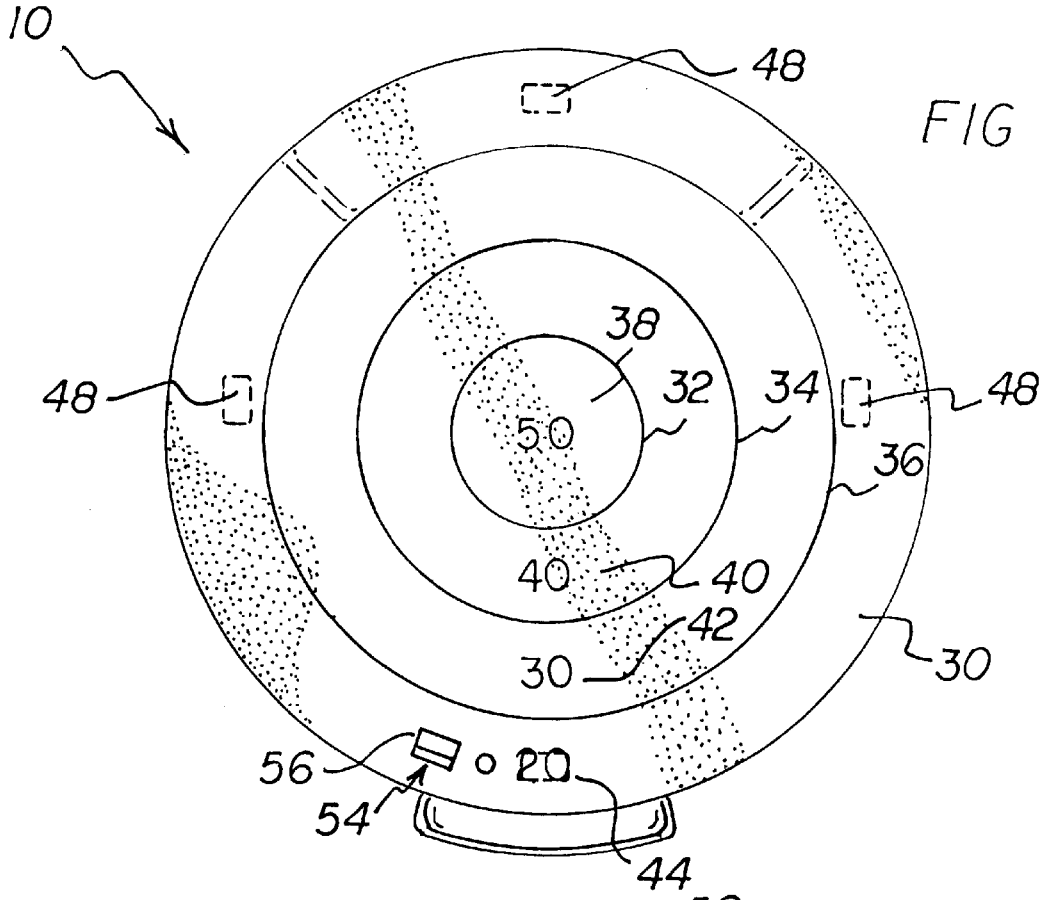
FIG. 1 is a top elevational view of the preferred embodiment of the inflatable beach pillow system with an attachable blanket constructed in accordance with the principles of the present invention.
Figure 2:
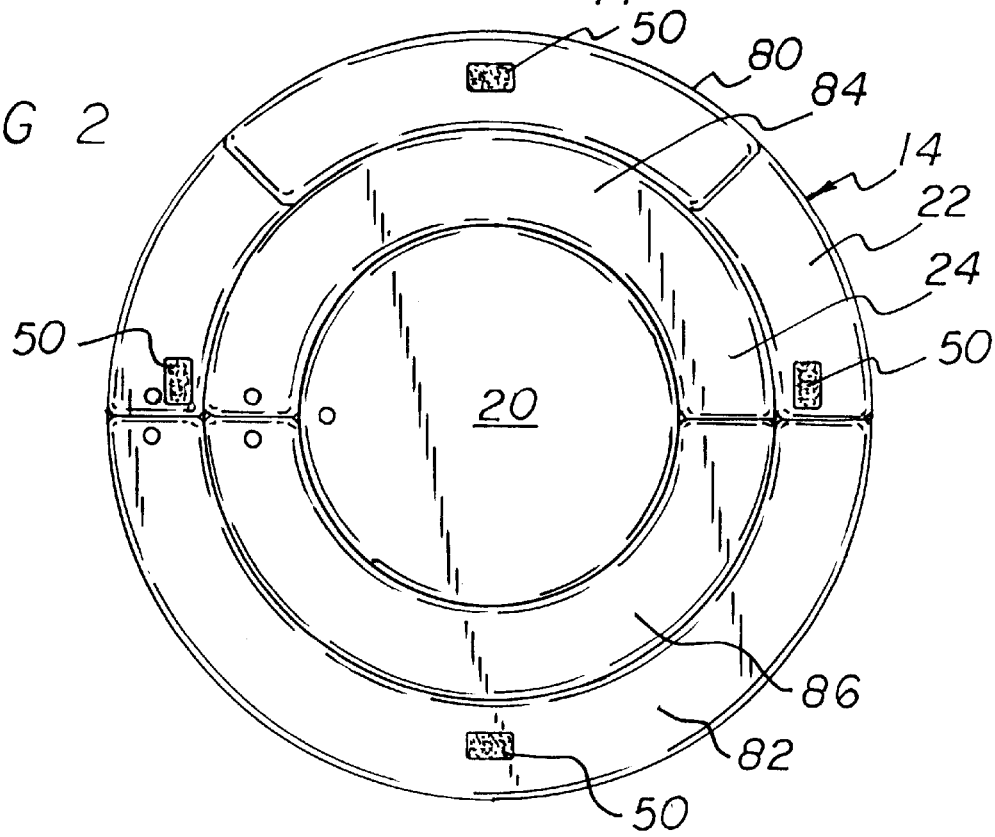
FIG. 2 is a top elevational of the device as shown in FIG. 1 but with the blanket removed.

With reference now to the drawings, and in particular to FIG. 1 thereof, the preferred embodiment of the new and improved Inflatable beach pillow system with an attachable blanket embodying the principles and concepts of the present invention and generally designated by the reference numeral 10 will be described.

The present invention, the Inflatable beach pillow system with an attachable blanket 10 is comprised of a plurality of components. Such components in their broadest context include a three inflatable sections and a separate inflatable arcuate section. Such components are individually configured and correlated with respect to each other so as to attain the desired objective.

The new and improved inflatable beach pillow system 10 with an attachable blanket for beach use as described herein comprises, in combination a pillow 14. The pillow is in a generally circular configuration and has an upper surface 16 and a lower surface 18. The pillow has a wedge-shaped cross-sectional profile. See FIG. 6. The pillow also has three inflatable sections including a circular interior section 20, an enlarged annular radially exterior section 22 having an upper enlarged annular radially exterior section 80 and a lower enlarged annular radially exterior section 82 and an annular intermediate section 24 therebetween. The annular intermediate section 24 having an upper annular intermediate section 84 and a lower annular intermediate section 86. Each of the sections are individually inflatable.

Also included is a separately inflatable arcuate section 26. The arcuate section is formed in the exterior section and extends for about ninety degrees of its extent. The arcuate section is adapted to constitute a head pillow when inflated with an inwardly sloping upper surface each of the inflatable sections having an individual valve.

Yet another component of the system is a blanket 30. The blanket is in a circular configuration and is adapted to be positioned on the upper surface of the pillow. The exterior surface of the blanket is formed with a plurality of concentric rings 32, 34, 36. The rings constitute scoring sections 38, 40, 42, 44 with indicia of "20" on the outermost section, "50" on the innermost section and with "40" and "30" at the sections adjacent thereto. Further, the blanket includes a pouch 70 for receiving and storing articles therein. The pouch is formed at the periphery of the blanket, diametrically opposed to the arcuate section.

Also included in the system is a plurality of pile-type fasteners 48. The pile-type fasteners are coupled to the lower surface of the blanket and a plurality of pile-type fasteners 50 are coupled to the upper surface of the pillow for the releasable coupling therebetween to allow removal between the pillow and blanket.

Lastly provided is a plurality of recesses. The recesses are formed in the outermost ring of the pillow and are essentially diametrically opposed to the arcuate section with a rectangular recess 54 and a cover patch 56 removably secured thereover by a pile-type fastener 58 for supporting suntan lotion 60 and a saturated pad 62 and a cylindrical recess 64 thereadjacent for the receipt of a beverage container.

Figure 3:
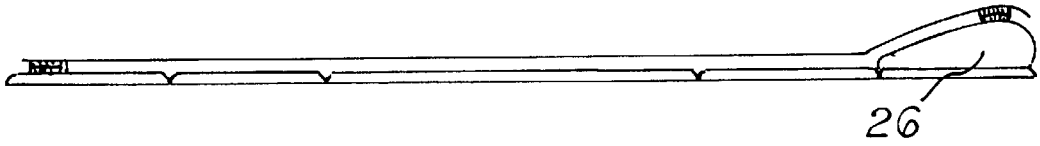
FIG. 3 is a cross-sectional view taken centrally through the device of FIG. 1 with the device deflated.

In use one or more of the pillows elements may be inflated for a variety of user defined configurations. As shown in FIG. 3, the separately inflatable arcuate section alone may be inflated. This configuration allows a user to only inflate the separately inflatable arcuate section functioning as a pillow while the user reclines on the inflatable beach pillow system.

Figure 4:
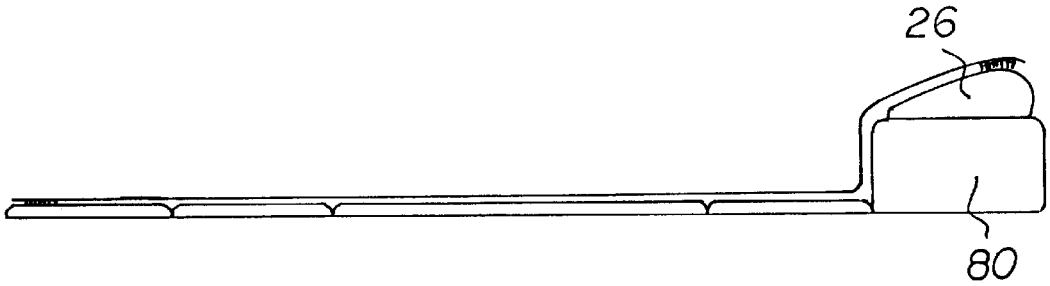
FIG. 4 is a view similar to FIG. 3 but with the arcuate section inflated.

Now referring to FIG. 4, the inflatable beach pillow system may have the separately inflatable arcuate section inflated in combination with the upper enlarged annular radially exterior section for functioning as a seat rest.

Figure 5:
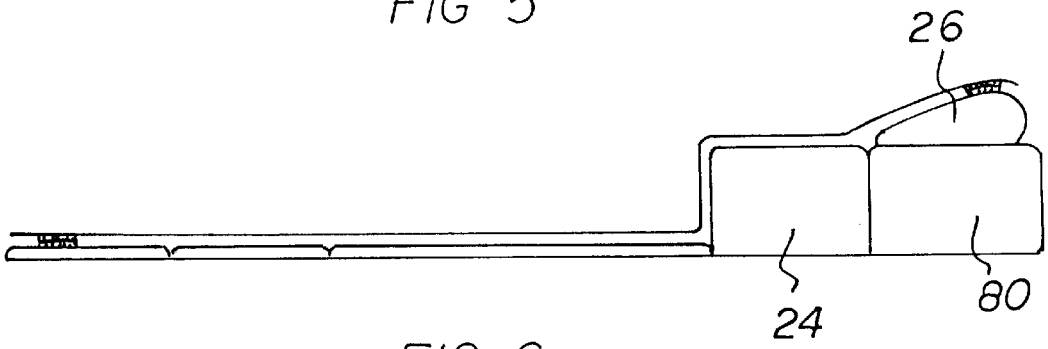
FIG. 5 is a cross-sectional view similar to FIG. 4 but with the arcuate section of the two exterior rings inflated.
Figure 6:
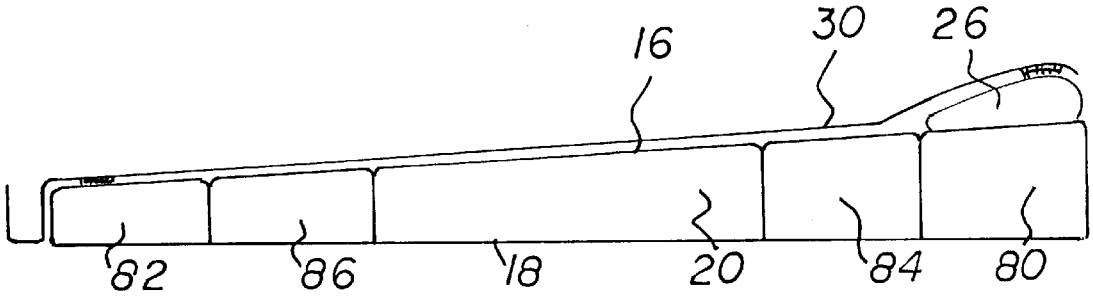
FIG. 6 is a view similar to FIG. 5 but with all of the rings inflated around the entire circumference.

Alternately, FIG. 5 shows the inflatable beach pillow system may have the separately inflatable arcuate section inflated in combination with the upper enlarged annular radially exterior section and the upper annular intermediate section for functioning as a chair-like device. Further, as shown in FIG. 6, the entire pillow may be inflated for allowing a user to recline thereon in a prone position.

As to the manner of usage and operation of the present invention, the same should be apparent from the above description. Accordingly, no further discussion relating to the manner of usage and operation will be proveded.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An inflatable beach pillow system with an attachable blanket for beach use comprising, in combination:

a pillow in a generally circular configuration having an upper surface and a lower surface and having three inflatable sections, a circular interior section, an enlarged annular radially exterior section and an annular intermediate section between the circular interior section and the enlarged radially exterior section, each of the sections having an individual valve and being individually inflatable;

a separately inflatable arcuate section formed in the exterior section and extending for about ninety degrees along an extent of the exterior section, the arcuate section adapted to constitute a head pillow with an inwardly sloping upper surface when inflated;

a blanket in a circular configuration adapted to be positioned on the upper surface of the pillow, the blanket having an exterior surface formed with a plurality of concentric rings to constitute scoring sections with indicia of "20" on an outermost section, "50" on an innermost section and with "40" at sections adjacent thereto;

a plurality of pile-type fasteners coupled to a lower surface of the blanket and a plurality of pile-type fasteners coupled to the upper surface of the pillow for the releasable coupling therebetween to allow removal between the pillow and blanket;

a plurality of recesses formed in the exterior section of the pillow essentially diametrically opposed to the arcuate section, having a rectangular recess and a cover patch removably secured thereover by a pile-type fastener for supporting suntan lotion and a saturated pad and a cylindrical recess thereadjacent for receipt of a beverage container; and wherein the enlarged annular radially exterior section comprises an upper enlarged annular radially exterior section and a lower enlarged annular radially exterior section and the annular intermediate section comprises an upper annular intermediate section and a lower annular intermediate section.

2. An inflatable beach pillow system with an attachable blanket comprising:

a pillow in a generally circular configuration having an upper surface and a lower surface and having a plurality of inflatable sections, a circular interior section, at least one enlarged annular radially exterior section and at least one annular intermediate section between the circular interior section and the at least one enlarged annular radially exterior section, each of the sections having an individual valve and being individually inflatable;

a separately inflatable arcuate section formed in the exterior section and extending for about ninety degrees along an extent of the at least one exterior section, the arcuate section adapted to constitute a head pillow with an inwardly sloping upper surface when inflated;

a blanket in a circular configuration adapted to be positioned on the upper surface of the pillow, the blanket having an exterior surface formed with a plurality of concentric rings to constitute scoring sections with indicia thereon;

a plurality of pile-type fasteners coupled to a lower surface of the blanket and a plurality of pile-type fasteners coupled to the upper surface of the pillow for the releasable coupling between the lower surface of the blanket and the upper surface of the pillow to allow removal between the pillow and blanket; and wherein the at least one enlarged annular radially exterior section includes an enlarged annular radially exterior section comprising an upper enlarged annular radially exterior section and a lower enlarged annular radially exterior section and the at least one annular intermediate section comprising an upper annular intermediate section and a lower annular intermediate section.

* * * * *